US008065803B2

(12) United States Patent
Austin

(10) Patent No.: US 8,065,803 B2
(45) Date of Patent: Nov. 29, 2011

(54) CUTTING TOOL

(75) Inventor: Michael Austin, Johnson City, TN (US)

(73) Assignee: Taylor Brands, LLC, Kingsport, TN (US)

( * ) Notice: Subject to any disclaimer, the term of this patent is extended or adjusted under 35 U.S.C. 154(b) by 500 days.

(21) Appl. No.: 12/137,402

(22) Filed: Jun. 11, 2008

(65) Prior Publication Data

US 2009/0307911 A1 Dec. 17, 2009

(51) Int. Cl.
*B26B 3/06* (2006.01)

(52) U.S. Cl. ..... 30/151; 30/162; 30/320; 30/340

(58) Field of Classification Search ..... 30/162, 30/125, 335, 340, 342, 320, 329, 337; 7/118; D8/98, 99
See application file for complete search history.

(56) References Cited

U.S. PATENT DOCUMENTS 4,713,885 A * 12/1987 Keklak et al. ..... 30/162
5,203,085 A * 4/1993 Berns ..... 30/163
5,303,474 A * 4/1994 Keklak et al. ..... 30/162
5,426,855 A * 6/1995 Keklak et al. ..... 30/162
5,495,670 A * 3/1996 Quinn ..... 30/162
5,924,203 A * 7/1999 Huang ..... 30/142
6,625,888 B2 * 9/2003 Heck et al. ..... 30/186
6,813,833 B2 * 11/2004 Saunders et al. ..... 30/162
6,829,827 B2 * 12/2004 Tseng ..... 30/162
6,886,257 B2 * 5/2005 Chih ..... 30/125
7,100,285 B1 * 9/2006 Huang ..... 30/162
7,305,729 B2 * 12/2007 Dehner ..... 7/158
7,316,070 B2 * 1/2008 Green ..... 30/162
7,322,110 B2 * 1/2008 Hernandez et al. ..... 30/162
7,533,467 B2 * 5/2009 Fossella ..... 30/162
7,596,869 B2 * 10/2009 Berns ..... 30/162

* cited by examiner

*Primary Examiner* — Boyer D Ashley
*Assistant Examiner* — Omar Flores Sanchez
(74) *Attorney, Agent, or Firm* — Luedeka, Neely & Graham, PC

(57) ABSTRACT

A cutting tool including a housing provided with a compartment having an opening, a carrier disposed in the compartment and displaceable between extended and retracted positions, a spring for biasing the carrier in the retracted position, a mechanism for displacing the carrier in the extended position, a mechanism for releasably retaining the carrier in the extended position, and the carrier having a nesting surface for a blade whereby a blade nested thereon will project through the compartment opening when the carrier is in the extended position and will be disposed within such compartment when the carrier is in the retracted position.

2 Claims, 4 Drawing Sheets

CUTTING TOOL

This invention relates to a cutting tool and more particularly to such a tool adapted to detachably mount a razor blade. This invention further contemplates such a tool which is ergonomically accommodating to a user.

BACKGROUND OF THE INVENTION

In the prior art, there has been developed a type of cutting tool utilizing conventional razor blades as severing devices. Often, such tools are used in manufacturing and other operations to sever various items such as tape, cardboard, strings and the like. Repetitive use of such tools can result in various physical problems to users which it would be useful and advantageous to eliminate. Accordingly, it is the principal object of the present invention to provide a cutting tool of the type described which is ergonomically friendly to users.

SUMMARY OF THE INVENTION

The principal object of the present invention is achieved by providing a cutting tool generally consisting of a housing having a forward section provided with a compartment with a forwardly extended opening, and a rearward section which may be manually griped; a carrier disposed in such compartment displaceable along a linear line of travel aligned with the compartment opening, between extended and retracted positions; means operatively interconnecting the housing and the carrier for biasing the carrier toward the retracted position; means operatively interconnecting the housing and the carrier for displacing the carrier to the extended position against the biasing action of the biasing means; means operatively interconnecting the housing and the carrier for releasably retaining the carrier in the extended position; and means disposed on a forward end of the carrier for mounting a blade disposable in a partially extending position through the compartment opening when the carrier is in the extended position and disposable within the compartment when the carrier is in the retracted position. Preferably, the forward section of the housing is angularly displaced at an angle of 19° relative to the rearward section of the housing, and the tool is provided with an opening through which the fingers of the user may be extended when the housing is grasped by the user. The tool further is contemplated to be formed of a plastic material having a smooth outer surface which would be comfortable and accommodating to the hand of the user.

DETAILED DESCRIPTION OF THE PREFERRED EMBODIMENT

Figure 1:
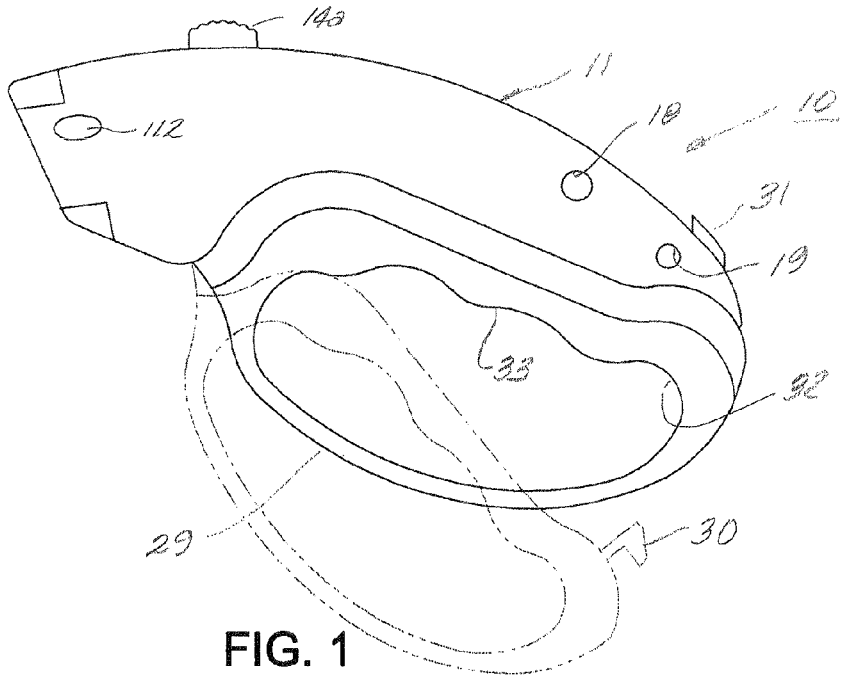
FIG. 1 is a side elevational view of an embodiment of the invention, illustrating the embodiment in an assembled condition in solid lines and a portion of the tool in an open condition in dotted lines.
Figure 2:
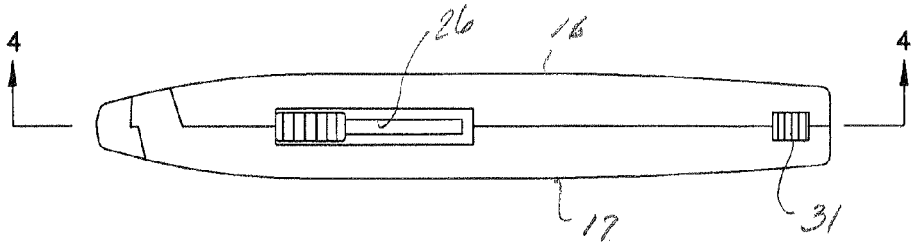
FIG. 2 is a top elevational view of the embodiment shown in FIG. 1.
Figure 3:
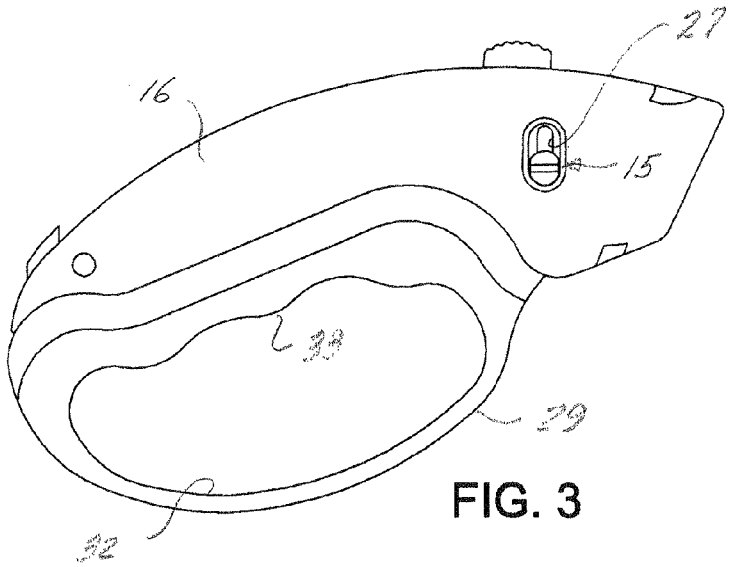
FIG. 3 is a view similar to the view shown in FIG. 1, illustrating, the opposite of the tool.

Referring to the drawings, there is illustrated a cutting tool 10 embodying the present invention which generally includes a housing 11, a carrier assembly 12 mounted in the housing assembly and displaceable between extended and retracted positions, a razor blade 13 mountable on the carrier assembly, a displacing mechanism 14 mounted on the housing and cooperable with the carrier assembly and a locking mechanism 15 also mounted on the housing and, co-operative with the carrier assembly. Housing 11 is formed by a pair of side members 16 and 17 secured together by means of a pair fasteners extended through openings 18 and 19. The housing further consists of a forwardly disposed section 20 and a rearwardly disposed section 21. A longitudinal centerline of rearwardly disposed section 21 is disposed at an angle of approximately 19° relative to a longitudinal centerline of forward by disposed section 20. Side members 16 and 17 are spaced apart to provide a pair of compartments 22 and 23 separated by a partition wall 24. Forward housing section 20 further is provided with an opening 25 in a forward end thereof communicating with compartment 22, and an opening 26 formed in the upper and thereof communicating with compartment 23 and an opening in side wall 16 also communicating with compartment 23. The rear housing section is provided with an opening 28 in a lower end thereof communicating with compartment 23. As best seen in FIGS. 1 and 3, the housing is provided with an arm member 29, pivotally connected to a lower portion of forward housing section 20 and cooperable with a lower end of rearward housing section 21. In a closed position as shown in solid lines in FIG. 1 and as also shown in FIG. 3, arm member 29 closes opening 28. The arm member is adapted to be detachably connected to the rearward housing section in the closed position by means of a latch 30 provided with a release button 31 on the rearward housing section to maintain the arm member in the closed position. To release the arm member from the closed position as shown in solid lines in FIG. 1 to an open position as shown in phantom lines in FIG. 1, button 31 is simply pressed to release latch element 31 and thus permit the arm member to swing to the open position. Arm member 29 further is provided with an opening 32 to accommodate the fingers of a user grasping the rearward housing section of the tool. A portion of the surface of opening 32 is provided with an undulating configuration as at 33 to accommodate the fingers of the user extending through opening 32.

Figure 4:
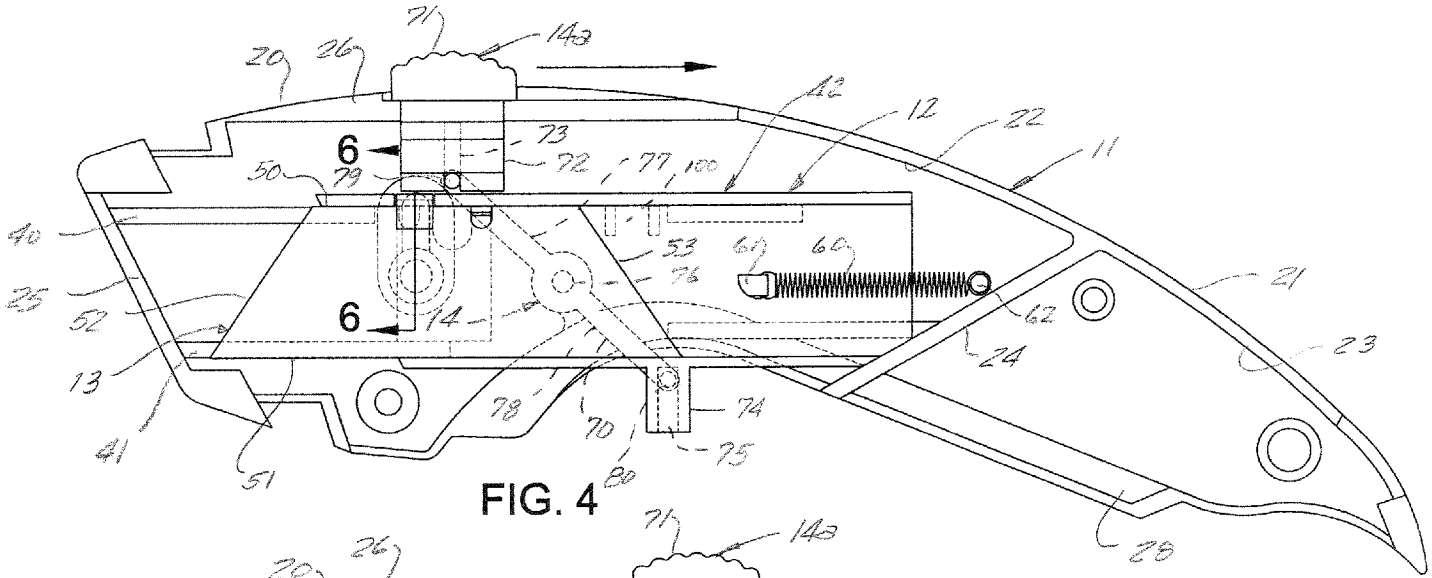
FIG. 4 is an enlarged cross-sectional view taken along line 4-4 and FIG. 2, illustrating the carrier member thereof in a retracted position.
Figure 5:
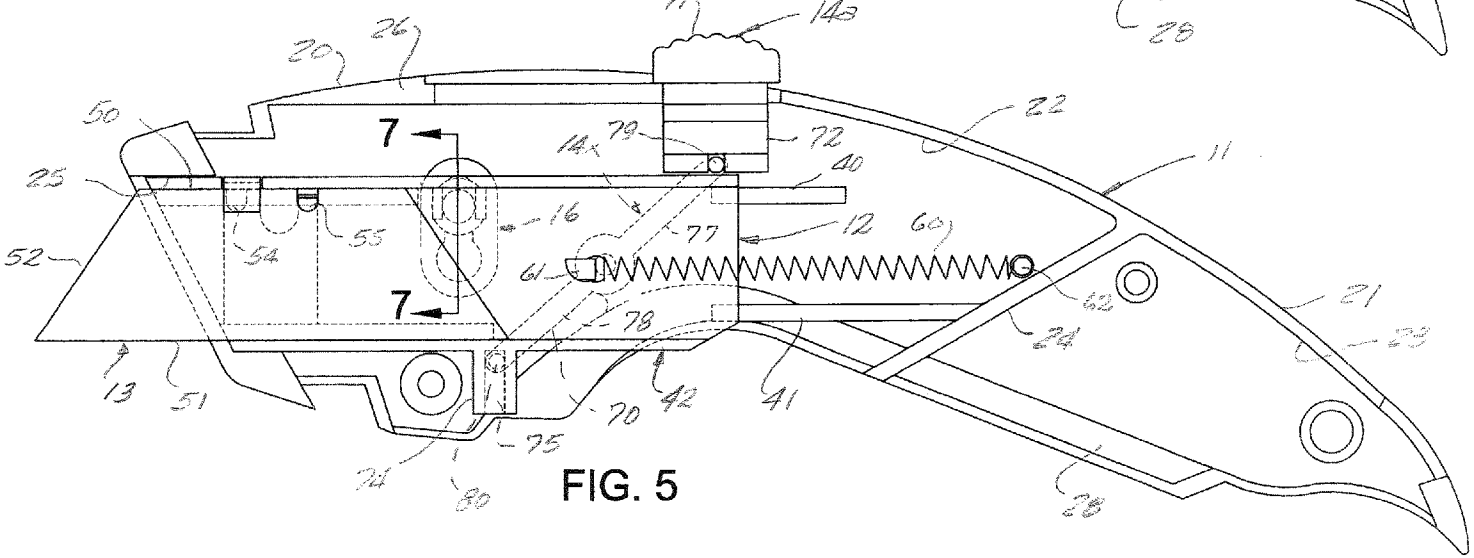
FIG. 5 is a view similar to the view shown in FIG. 4, illustrating the carrier member thereof in an extended position.

Referring to FIGS. 4 through 7 of the drawings, the inner side of housing side section 16 is formed with a pair of upwardly and lowardly spaced, parallel guide tracks 40 and 41 which are interrupted at intermediate portions thereof. Such guide tracks are aligned with opening 25 in the front end of the forward housing section. The carrier assembly 12 consists of an elongated carrier member 42 having a substantially I-shaped configuration, as partially shown in FIG. 6. Such configuration includes a web portion 43, and upper and lower flange portions 44 and 45. The outer segments of flange portions 44 and 45 cooperate with guide tracks 40 and 41 to permit carrier 42 to be displaced along the length of the guide tracks. The forward end of carrier 42 is provided with a configuration permitting the nesting of the razor blade 13 as shown in FIGS. 4 and 5. Blade 13, as previously indicated, has a trapezoidal configuration including an upper edge 50, a lower sharpened edge 51 disposed parallel to upper edge 50 and a pair of diverting side edges 52 and 53. The spacing between upper and lower edges 50 and 51 is similar to the spacing between flange portions 44 and 45 of the carrier to permit the blade to be nested between such flange portions. The upper edge 50 of the blade is provided with a pair of notches 54 and 55 through which a portion of the carrier may be received to fix the position of the blade relative to the carrier and preclude displacement of the blade relative to the carrier along the line of travel of the carrier, as will later be described. The carrier along with a blade 13 mounted therein is biased in a rearwardly disposed, retracted position, as shown in FIG. 4, by means of a spring 60 interconnecting carrier 42 as at 61 and the housing as at 62.

Carrier member 42 with blade 13 mounted on the forward end thereof is adapted to the displaced from the retracted position as shown in FIG. 4 with blade 13 disposed entirely within compartment 22, to an extended position as shown in FIG. 5 with the forward end of blade 13 extending through opening 25, by means of displacing mechanism 14. Such mechanism includes a lever 70 pivotally mounted on the housing having end portions cooperating, with carrier 42 and a button 14*a*. When such button is displaced from the position as shown in FIG. 4 to the position as shown in FIG. 5, lever 70 will pivot and correspondingly cause the carrier to displace from the retracted to the extended position. Button 14*a* includes a finger engaging portion 71 and a depending portion 72 extending through opening 26 in the housing and being provided with a slot 73. Button 14*a* is displaceable along a line of travel substantially parallel to the line travel of carrier 42, and slot 73 is disposed at an angle substantially perpendicular to the line of travel of carrier 42. Lower flange 45 of the carrier is provided with a depending portion 74 which is provided with a slot 75 also disposed perpendicularly with respect to the line of travel of carrier 42. Lever 70 is pivotal in a plane disposed substantially parallel to web section 43 of the carrier, is pivotally connected at a midpoint thereof to a stub shaft 76 formed on an inner side of side member 17 within compartment 22, and is provided with aligned radial arm sections 77 and 78. Arm section 77 is provided with a protrusion 79 which is adapted to ride along slot 73 of depending portion 72 and arm section 78 is provided with a protrusion 80 which is adapted to displace along the length of slot 75 of flange portion 74 when lever 70 is pivoted. It will be appreciated that when button 14*a* is in the position as shown in FIG. 4, with the carrier in the retracted position and blade 13 disposed of entirely within compartment 23, the carrier may be displaced to the extended position as shown in FIG. 5 with the forward end of the blade extending out beyond the housing, by simply displacing button 14*a* rearwardly to the position as shown in FIG. 5. The carrier may then be retracted to position the blade within the housing simply by displacing button 14*a* forwardly from the position as shown in FIG. 5 to the position as shown in FIG. 4.

Figure 6:
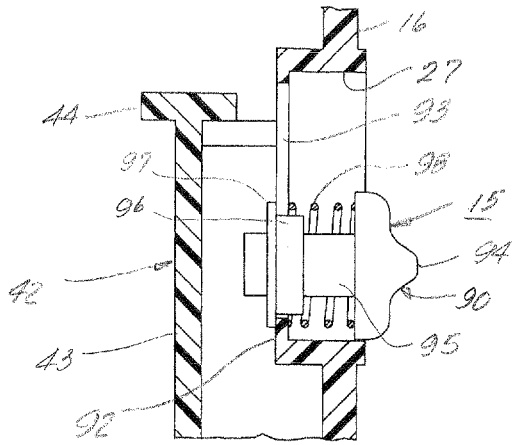
FIG. 6 is an enlarged, cross-sectional view taken along line 6-6 in FIG. 4, illustrating a locking mechanism in an unlock position.
Figure 7:
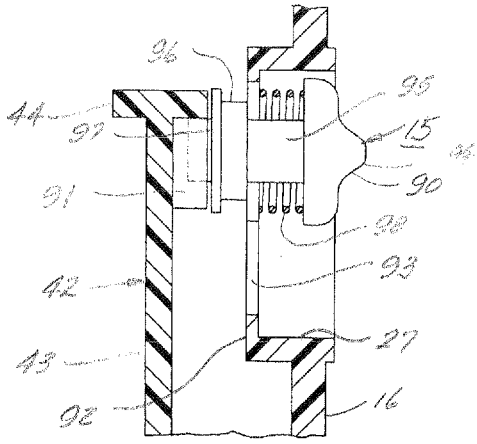
FIG. 7 is an enlarged, cross-sectional view taken along line 7-7 in FIG. 5, illustrating the locking mechanism in an unlocked position.

Locking mechanism 15 includes a button 90 disposed in a recess 27 in housing side wall 16, and cooperates with a portion 91 of the carrier member depending from upper flange portion 44. Recess 27 is provided with an inner wall 92 having a slot 93 disposed perpendicularly with respect to the line of travel of carrier 42. Button 90 consists of a finger engaging portion 94 adapted to ride in recess 27, a stub shaft portion 95 adapted to be displaced along slot 93, an annular portion 96 formed on stub portion of 95, having a diameter equal or slightly smaller than an enlarged circular section 93*a* of slot 93, an annular portion 97 having a diameter greater than the diameter of enlarged opening 93*a* and a spring 98 displaced between finger engaging portion 94 and annular portion 97. When the button is in the position as shown in FIG. 6, annular portion 96 will be received in enlarged opening 93*a* and spring 98 will cause annular portion 96 to be received within the enlarged opening 93*a* to maintain the button in a lower position. When finger engaging portion 94 is depressed, annular portion 96 will be displaced out of enlarged opening portion 93*a* of slot 93 to permit the button to be displaced upwardly to the position as shown in FIG. 7. Portion 91 of carrier 42 is provided with a slot 100, as best shown in FIG. 4, whereby when the carrier is in the position as shown in FIG. 5, slot 100 will register with slot 93 to permit the end portion 91 of stub shaft 95 to be inserted in slot 100, when button 90 is moved upwardly to the position as shown in FIG. 7 to correspondingly lock the carrier in the extended position as shown in FIG. 5.

When the tool is in the condition as shown in FIG. 4 with the carrier in the retracted position and the blade within the compartment 23, and the carrier biasingly retained in compartment 23 by means of spring 60, button 14*a* will be disposed in a forwardly disposed position and button 94 will be disposed in a lower position as shown in FIG. 6. When it is desired to extend the carrier from the retracted to the extended position to project the forward end of the blade through opening 25, button 14*a* is engaged with a finger and retracted from the position shown in FIG. 4 to the position as shown in FIG. 5, to transversely register slot 100 of the carrier with slot 93 of the lock mechanism, and then button 94 is depressed and moved upwardly to cause the end of stub shaft 95 to be received within slot 100 to correspondingly lock the carrier in the position as shown in FIG. 5. As button 14*a* is displaced rearwardly, lever 70 will be caused to pivot and protrusion 80 will react with slide 75 to cause the carrier to displace along its line of travel. When button 94 is depressed, annular portion 96 will be displaced out of circular opening 93 in slot 93, aligning stub portion 95 with slot 93 and permitting button 94 to be displaced upwardly to insert the end of the stub shaft 95 in slot 100. When button 94 is in its upper most position as shown in FIG. 7, spring 98 will cause annular portion 96 to be biased against the wall of slot 93 to retain the button in the upper, locking position. The carrier may be unlocked from the position as shown in FIG. 5, permitting it to displace to the position as shown in FIG. 4, under the action of spring 60 simply by engaging button 94 and moving it downwardly so that annular portion 96 again registers with enlarged opening 93*a* and spring 98 causes annular section 96 to reenter enlarged slot section 93*a*.

In the use of the tool as described, the rearward housing section of the tool is grasped with a hand of the user, with the fingers being received through opening 92, for firmly grasping the tool and allowing the thumb to engage button 14*a*. When it is desired to extend the blade for use of the tool, the thumb is used to engage button 14*a* and retract it and thus cause the carrier to displace from the retracted position as shown in FIG. 4 to the extended position as shown in FIG. 5. The carrier can be locked in such position simply by pressing button 94 and sliding it upwardly to lock the carrier in the extended position. If it is desired to retract the blade, the procedure as described is reversed to move the carrier from the extended to the retracted position and thus move the blade to within compartment 23. Arm member 29 may be pivotally displaced from the rearward housing section simply by moving button 31 to detach the latch member, and swinging the arm member outwardly to expose the opening in the bottom portion of rearward arm section 21. Opening 28 permits spare blades to be stored in compartment 24. Preferably, the various components of the tool may be formed of a plastic material with smooth merging surfaces to permit the comfortable and use of the tool. As previously indicated, the portion of opening 32 engaged by the fingers of the user is provided with a contour to accommodate the engagement of the fingers extending through opening 32.

Figure 9:
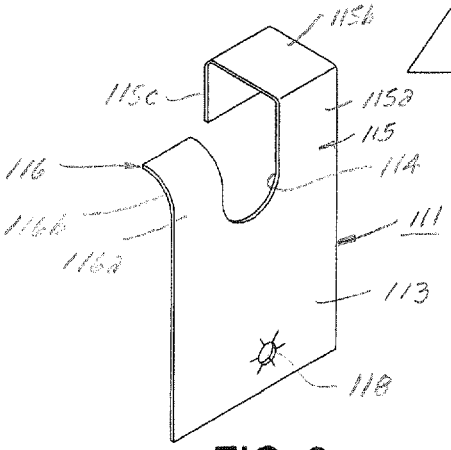
FIG. 9 is an enlarged, perspective view of a leaf spring member consisting of a component of the blade securing mechanism shown in FIG. 8.
Figure 10:
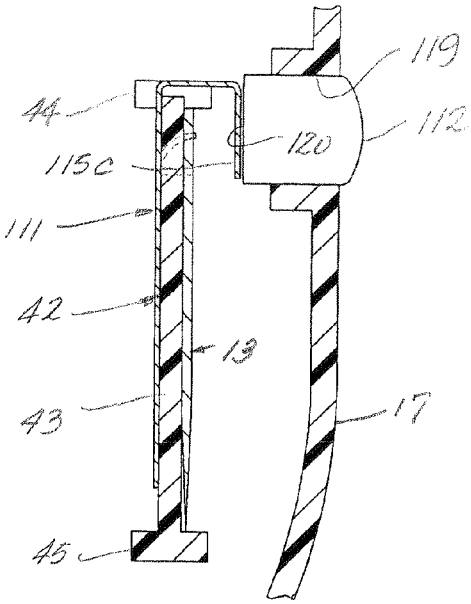
FIG. 10 is an enlarged cross-section taken along line 10-10 in FIG. 8, illustrating the blade securing mechanism in a blade attaching condition.
Figure 11:
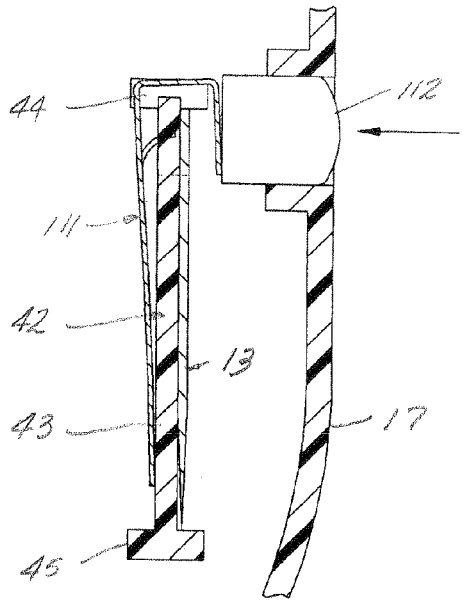
FIG. 11 is a view similar to the view shown in FIG. 10, illustrating the blade securing mechanism in a blade detached condition.
Figure 12:
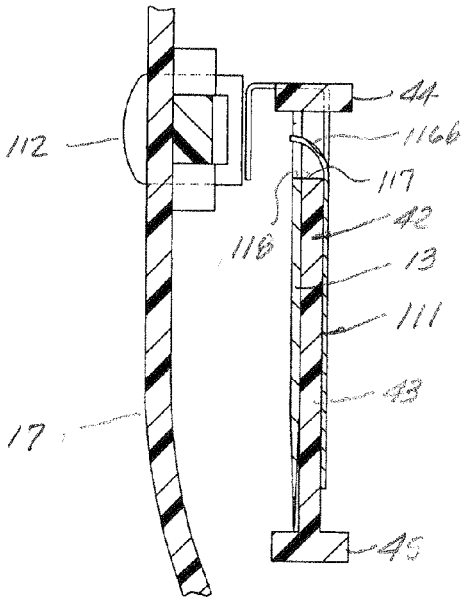
FIG. 12 is an enlarged cross-section taken along lines 12-12 in FIG. 8, illustrating the blade securing mechanism in a blade attaching condition.
Figure 13:
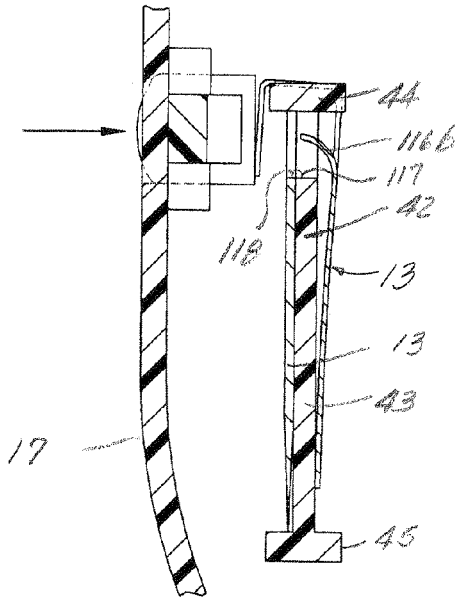
FIG. 13 is a view similar to the view shown in FIG. 12, illustrating the blade securing mechanism in the blade detached condition.

Referring to FIGS. 9 through 13 of the drawings, there is illustrated a retaining mechanism for releasably securing blade 13 on carrier member 42. The mechanism generally consists of a leaf spring member 111 mounted on the carrier member and cooperable with a notch 54 or 55 in the blade to preclude the longitudinal displacement of the blade relative to the carrier when the blade is mounted on the carrier, and a release button 112 mounted on housing wall 17 and cooperable with such leaf spring member. As shown in FIG. 9, the leaf spring member consists of a flat piece of spring steel having a planar section 113 provided with a recess 114 in an end thereof to provide a pair of projecting sections 115 and 116. Projecting section 115 includes a planar portion 115*a* disposed coplanarly with planar section 113, a planar portion 115*b* disposed at a right angle to planar portion 115*a* and a planar portion 115*c* disposed at a right angle to planar section 115*b*. Projecting section 116 includes a planar portion 116*a* disposed coplanarly with planar section 113 and a curved portion 116*b* turned in the same direction as planar portion 115*b*. As best seen in FIGS. 10 through 13, leaf spring member 111 is mounted on carrier member 42 with planar section 113 overlying the inner side of web section 43 of the carrier member, protruding section 15 extending through an opening in and over upper flange section 44 with protruding portion 15*c* being disposed on the outer side of carrier web section 43, and curved portion 116*a* being received in an opening 117 in the web section of the carrier member as best shown in FIGS. 12 and 13. The lower end of planar section 113 is rigidly connected to web section 43 of the carrier member to permit the opposite end of the leaf spring members to flex between the position as shown in FIGS. 10 and 12 and the position as shown in FIGS. 11 and 14. As shown in FIG. 9, the free end portion of section 113 may be provided with an opening 118 which may be utilized to fuse a lower end of the leaf spring member to the web section of the carrier member or to otherwise secure such a section to the web section.

Figure 8:
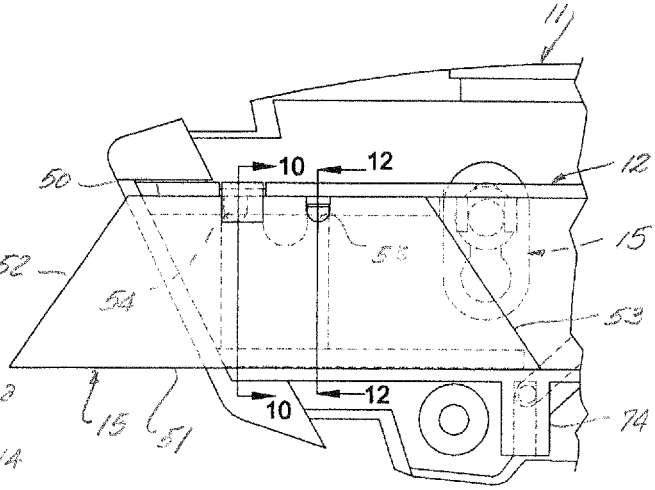
FIG. 8 is a partial view of the view shown in FIG. 5, illustrating a mechanism for detachably securing the blade to the carrier.

When blade 13 is nested on the carrier member as shown in FIGS. 4, 5 and 8, one of such notches will register and be in lateral alignment with notch 17 in the web section of the carrier member. Under such circumstances, curved portion 116*b* of the leaf spring member will normally be positioned within such registered notch as shown in FIGS. 10 and 12.

Release button 112 is disposed in an opening 119 in housing side wall 17 and is provided with an inner wall member 120 which faces portion 115*c* of the leaf spring member in lateral alignment when the carrier member is in the extended position as shown in FIGS. 5 and 8. When button 112 and portion 115*c* of the leaf spring member are in transverse alignment, release button 112 may be pressed to engage and displace portion 115*c*.

To insert a blade into the tool, button 14*a* is first engaged and moved forwardly to position the carrier member in the position as shown in FIGS. 5 and 8. Under such conditions, the leaf spring member will be in the position as shown in FIGS. 10 and 12 with curved portion 16*a* received in notch 117 in the web section of the carrier member and planar section 115*c* of the leaf spring member disposed in transverse alignment with release pin 112. To insert and secure the blade on the carrier member, the release button is pressed to retract the upper end of the leaf spring member as shown in FIGS. 11 and 13, the blade is inserted through opening 25 and nested on the carrier member with notch 54 transversely aligned with notch 117 in the web section of the carrier member, and the release button 112 is released back into engagement with the web section of the carrier member, thus inserting curved portion 116*b* into the registered notch in a blade to preclude the longitudinal displacement of the blade relative to the carrier member. To remove a blade from the carrier member, the procedure as described essentially is reversed. To facilitate the insertion or removal of a blade, the carrier may be secured in the extended position by the use of locking mechanism 15. Otherwise, the carrier member may be held in the extended position by holding button 114*a* and then releasing such button after the blade has been attached, thus permitting spring 60 to retract the carrier into the retracted position as shown in FIG. 4. In the normal use of the tool as described, button 14*a* may be displaced to displace the carrier member between the extended and retracted positions, locking mechanism 15 may be used to lock the carrier in the extended position and the retaining mechanism may be used to insert and remove blades from the carrier member.

The tool described is not only simple in design and effective in use, but egromatically designed to accommodate the user and minimize effort of use.

What is claimed is:

1. A cutting tool comprising:

a housing having a forward section provided with a compartment with a forwardly extending opening, and a rearward section which may be manually gripped; a carrier disposed in said compartment, displaceable along a linear line of travel aligned with said compartment opening, between extended and retracted positions;

means operatively interconnecting said housing and said carrier for biasing said carrier toward said retracted position;

means operatively interconnecting said housing, and said carrier for displacing said carrier to said extended position against the biasing action of said biasing means;

means operatively interconnecting said housing and said carrier for releasably retaining said carrier in said extended position; and means disposed on a forward end of said carrier for mounting a blade disposable in partially extending position through said compartment opening when said carrier is in said extended position and disposable within said compartment when said carrier is in said retracted position, wherein said carrier includes a slot disposed substantially perpendicular to said line of travel of said carrier, and said carrier displacing means includes a button mounted on said housing, displaceable along a line of travel disposed parallel to said line of travel of said carrier and having a slot disposed substantially perpendicular to said line of travel of said carrier, and a lever pivotally connected to said housing having a first arm section with a protrusion disposed in and displaceable along said slot in said carrier and a second arm section with a protrusion disposed in and displaceable along said slot in said button whereby upon displacement of said button along the line of travel thereof, said lever will pivot, correspondingly causing said carrier to displace along the line of travel thereof.

2. A cutting tool according to claim 1 wherein said housing includes a longitudinally disposed opening communicating with said compartment and said button is disposed in and displaceable along said opening.

* * * * *